US009479871B2

(12) United States Patent
Kim et al.

(10) Patent No.: US 9,479,871 B2
(45) **Date of Patent: *Oct. 25, 2016**

(54) METHOD, MEDIUM, AND SYSTEM SYNTHESIZING A STEREO SIGNAL

(71) Applicant: Samsung Electronics Co., Ltd., Suwon-si, Gyeonggi-do (KR)

(72) Inventors: Junghoe Kim, Seoul (KR); Eunmi Oh, Seongnam-si (KR); Kihyun Choo, Seoul (KR); Miao Lei, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 347 days.

This patent is subject to a terminal disclaimer.

(21) Appl. No.: 14/134,508

(22) Filed: Dec. 19, 2013

(65) Prior Publication Data

US 2014/0105404 A1 Apr. 17, 2014

Related U.S. Application Data

(63) Continuation of application No. 11/707,990, filed on Feb. 20, 2007, now Pat. No. 8,620,011.

(60) Provisional application No. 60/778,932, filed on Mar. 6, 2006.

(30) Foreign Application Priority Data

May 30, 2006 (KR) ..... 10-2006-0049036
Nov. 7, 2006 (KR) ..... 10-2006-0109523

(51) Int. Cl.
*H04R 5/00* (2006.01)
*H04R 5/02* (2006.01)

(Continued)

(52) U.S. Cl.
CPC ..... *H04R 5/02* (2013.01); *G10L 19/008* (2013.01); *H04S 1/002* (2013.01); *H04S 3/002* (2013.01);*H04S 3/02* (2013.01); *H04R 5/033* (2013.01); *H04S 3/00* (2013.01); *H04S 2420/01* (2013.01); *H04S 2420/07* (2013.01)

(58) Field of Classification Search
CPC ..... H04S 1/00; H04S 1/002; H04S 1/005; H04S 3/00; H04S 5/033; H04S 5/04; H04S 2400/01; H04S 2420/01; H04S 2420/07; H04S 5/00; H04R 5/027; H04R 5/04; H04R 5/00; H04R 5/033
USPC ..... 381/1, 17–23, 309, 310, 74, 26
See application file for complete search history.

(56) References Cited

U.S. PATENT DOCUMENTS 5,524,054 A 6/1996 Spille
5,850,456 A 12/1998 Ten Kate et al.

(Continued)

FOREIGN PATENT DOCUMENTS

CN 1669359 A 9/2005
CN 101647158 A 2/2010

(Continued)

OTHER PUBLICATIONS

Korean Office Action issued Oct. 24, 2013 in Korean Patent Application No. 10-2012-0108275.

(Continued)

*Primary Examiner* — Xu Mei
(74) *Attorney, Agent, or Firm* — Sughrue Mion, PLLC

(57) ABSTRACT

A method, medium, and system generating a 3-dimensional (3D) stereo signal in a decoder by using a surround data stream. According to such a method, medium, and system, a head related transfer function (HRTF) is applied in a quadrature mirror filter (QMF) domain, thereby generating a 3D stereo signal by using a surround data stream.

4 Claims, 7 Drawing Sheets

(51) Int. Cl.

| | |
|---|---|
| ***G10L 19/008*** | (2013.01) |
| ***H04S 1/00*** | (2006.01) |
| ***H04S 3/02*** | (2006.01) |
| *H04R 5/033* | (2006.01) |
| *H04S 3/00* | (2006.01) |

(56) References Cited

U.S. PATENT DOCUMENTS

| | | | | |
|---|---|---|---|---|
| 7,006,636 | B2 | 2/2006 | Baumgarte et al. | |
| 7,068,792 | B1 | 6/2006 | Surazski et al. | |
| 7,876,904 | B2 | 1/2011 | Ojala et al. | |
| 7,987,097 | B2 | 7/2011 | Pang et al. | |
| 8,225,212 | B2 * | 7/2012 | Thiyagarajan | G06F 3/0485 709/203 |
| 8,620,011 | B2 * | 12/2013 | Kim | G10L 19/008 381/1 |
| 9,071,920 | B2 * | 6/2015 | Moon | H04S 3/008 |
| 2002/0006081 | A1 | 1/2002 | Fujishita | |
| 2002/0154900 | A1 | 10/2002 | Shimada | |
| 2003/0026441 | A1 | 2/2003 | Faller | |
| 2003/0219130 | A1 | 11/2003 | Baumgarte et al. | |
| 2003/0236583 | A1 | 12/2003 | Baumgarte et al. | |
| 2004/0117193 | A1 | 6/2004 | Kawai | |
| 2005/0135643 | A1 | 6/2005 | Lee et al. | |
| 2005/0157883 | A1 | 7/2005 | Herre et al. | |
| 2005/0195981 | A1 | 9/2005 | Faller et al. | |
| 2005/0271213 | A1 | 12/2005 | Kim | |
| 2005/0276420 | A1 | 12/2005 | Davis | |
| 2005/0281408 | A1 | 12/2005 | Kim et al. | |
| 2006/0206323 | A1 | 9/2006 | Breebaart | |
| 2007/0189426 | A1 | 8/2007 | Kim et al. | |
| 2008/0008327 | A1 | 1/2008 | Ojala et al. | |
| 2010/0087097 | A1 | 4/2010 | Hogue et al. | |

FOREIGN PATENT DOCUMENTS

| | | |
|---|---|---|
| JP | 11-225390 | 8/1999 |
| JP | 2001-352599 | 12/2001 |
| JP | 2004-194100 | 7/2004 |
| JP | 2004-312484 | 11/2004 |
| JP | 2005-069274 | 3/2005 |
| JP | 2005-094125 | 4/2005 |
| JP | 2005-098826 | 4/2005 |
| JP | 2005-101905 | 4/2005 |
| KR | 1996-0039668 | 11/1996 |
| KR | 2001-0086976 | 9/2001 |
| KR | 10-2002-0018730 | 3/2002 |
| KR | 10-2002-0082117 | 10/2002 |
| KR | WO 03/028407 | 4/2003 |
| KR | 2004-78183 | 3/2004 |
| KR | 10-2005-0115801 | 12/2005 |
| KR | 10-2006-0047444 | 5/2006 |
| KR | 10-2006-0049941 | 5/2006 |
| KR | 10-2006-0109299 | 10/2006 |
| KR | 10-2007-0005469 | 1/2007 |
| KR | 10-2007-0035411 | 3/2007 |
| KR | 10-2007-0078398 | 7/2007 |
| KR | 10-2007-0080850 | 8/2007 |
| KR | 10-0763919 | 9/2007 |
| WO | 02/07481 | 1/2002 |
| WO | 2004/008805 | 1/2004 |
| WO | 2004/019656 | 3/2004 |
| WO | 2004/097794 | 11/2004 |
| WO | 2005/036925 | 4/2005 |
| WO | 2005/101370 | 10/2005 |
| WO | 2007/080212 | 7/2007 |

OTHER PUBLICATIONS

Korean Office Action issued Oct. 24, 2013 in Korean Patent Application No. 10-2012-0064601.
Japanese Office Action issued Jun. 11, 2013 in Japanese Patent Application No. 2012-253715.
US Office Action issued Apr. 7, 2014 in U.S. Appl. No. 11/652,031.
US Office Action issued Nov. 7, 2014 in U.S. Appl. No. 11/652,031.
Korean Office Action dated Jul. 30, 2013 in Korean Patent Application No. 10-2012-0108275.
Korean Office Action dated Jul. 30, 2013 in Korean Patent Application No. 10-2012-0064601.
ISO/IEC JTC 1/SC 29/WG 11 N7983, "Coding of Moving Pictures and Audio", Apr. 2006, Montreux.
J. Herre et al., The Reference Model Architecture for MPEG Spatial Audio Coding, Audio Engineering Society Convention Paper 6447, USA, Audio Engineering Society, May 28, 2005.
ISO/IEC JTC1/SC29/WG 11 MPEG2005/M12886, "Coding of Moving Pictures and Audio", Jan. 2006, Bangkok, Thailand.
ISO/IEC JTC 1/SC 29/WG 11 N7530 "Coding of Moving Pictures and Audio", Oct. 2005, Nice, France.
Korean Non-Final Rejection mailed Jul. 18, 2011 corresponds to Korean Patent Application No. 10-2011-0056345.
Korean Notice of Allowance mailed Jul. 26, 2011 corresponds to Korean Patent Application No. 10-2007-0067134.
Japanese Office Action mailed Jun. 7, 2011 corresponds to Japanese Patent Application No. 2008-550238.
Japanese Office Action dated Feb. 15, 2011 corresponds to Chinese Patent Application No. 2008-550237.
Extended European Search Report issued by the European Patent Office on Jan. 1, 2010 in correspondence to European Patent Application No. 07708484.9.
Korean Non-Final Rejection mailed Jun. 27, 2012 corresponds to Korean Application No. 10-2012-0064601.
Korean Non-Final Rejection mailed Apr. 30, 2012 corresponds to Patent Application No. 10-2006-0049034.
Korean Non-Final Rejection dated Dec. 3, 2012 in Korean Application No. 10-2012-0108275.
Extended European Search Report dated Dec. 3, 2012 in European Patent Application No. 12164460.3-2225.
Japanese Final Rejection mailed Jul. 24, 2012 in Japanese Application No. 2008-550238.
Korean Notice of Allowance dated Sep. 28, 2012 in Korean Application No. 10-2012-0083520.
Korean Office Action dated Aug. 14, 2012 in Korean Application No. 10-2011-0056345.
Korean Notice of Allowance dated Sep. 28, 2012 in Korean Application No. 10-2006-0049034.
European Search report dated Sep. 10, 2012 in European Application No. 12002670.3-2225.
European Search report issued on Jul. 16, 2012 in European Patent Application No. 12170289.8-2225.
European Search report issued on Jul. 16, 2012 in European Patent Application No. 12170294.8-2225.
Notice of Allowance issued Aug. 29, 2007 in Korean Application No. 10-2006-0075301.
Notice of Last Non-Final Rejection issued Feb. 27, 2013 in Korean Application No. 10-2012-0064601.
Notice of Preliminary Reexamination dated Feb. 19, 2013 in Japanese Application No. 2008-550238.
Breebaart Jeroen, et al. "The Reference Model Architecture for MPEG Spatial Audio Coding", AES Convention 118 May 2005, AES, 60 East 42nd Street, Room 2520 New York.
Korean Notice of Allowance issued Sep. 20, 2007 corresponds to Korean Patent Application No. 10-2006-0109523.
Extended European Search Report dated Feb. 5, 2010 corresponds to European Application No. 07715470.6-2225.
E. D. Scheirer et al., "AudioBIFS: Describing Audio Scenes with the MPEG-4 Multimedia Standard," IEEE Transactions on Multimedia, Sep. 1999, vol. 1, No. 3, pp. 237-250.
Breebart, J. et al. "MPEG Spatial Audio Coding/MPEG Surround: Overview and Current Status" In: Proc. 119th AES Convention, New York, Oct. 2005.
PCT International Search Report issued Jun. 12, 2007 in corresponding Korean PCT Patent Application No. PCT/KR2007/001066.
PCT International Search Report issued Apr. 12, 2007 in corresponding Korean PCT Patent Application No. PCT/KR2007/000201.

(56) References Cited

OTHER PUBLICATIONS

PCT International Search Report issued Jun. 14, 2007 in corresponding Korean PCT Patent Application No. PCT/KR2007/001067.
US Office Action issued Aug. 15, 2013 in copending U.S. Appl. No. 11/652,031.
US Office Action mailed Mar. 27, 2013 in copending U.S. Appl. No. 11/652,687.
US Office Action mailed Nov. 7, 2011 in copending U.S. Appl. No. 11/652,687.
US Office Action mailed Jun. 1, 2011 in copending U.S. Appl. No. 11/652,687.
US Office Action mailed Oct. 5, 2010 in copending U.S. Appl. No. 11/652,687.
US Office Action mailed Apr. 11, 2012 in copending U.S. Appl. No. 11/652,031.
US Office Action mailed Mar. 17, 2011 in copending U.S. Appl. No. 11/652,031.
US Office Action mailed Nov. 1, 2011 in copending U.S. Appl. No. 11/652,031.
US Notice of Allowance mailed Aug. 26, 2013 in U.S. Appl. No. 11/707,990.
US Office Action mailed Sep. 10, 2012 in U.S. Appl. No. 11/707,990.
US Office Action mailed Dec. 19, 2011 in U.S. Appl. No. 11/707,990.
US Office Action mailed Mar. 2, 2011 in U.S. Appl. No. 11/707,990.
U.S. Appl. No. 11/652,687, filed Jan. 12, 2007, Sangchul Ko et al., Samsung Electronics Co., Ltd.
U.S. Appl. No. 11/652,031, filed Jan. 11, 2007, Junghoe Kim et al., Samsung Electronics Co., Ltd.
Communication dated Jan. 20, 2015 issued by the State Intellectual Property Office in People's Republic of China in counterpart Chinese Application No. 201210459124.7.
US Office Action issued Feb. 14, 2014 in U.S. Appl. No. 11/652,687.
US Notice of Allowance issued Jul. 8, 2014 in U.S. Appl. No. 11/652,687.
Communication from the State Intellectual Property Office of P.R. China dated Apr. 23, 2015 in a counterpart Chinese application No. 201210458826.3.

* cited by examiner

METHOD, MEDIUM, AND SYSTEM SYNTHESIZING A STEREO SIGNAL

CROSS-REFERENCE TO RELATED APPLICATIONS

This application is a continuation of U.S. patent application Ser. No. 11/707,990, filed on Feb. 20, 2007, which is currently pending, and which claims the benefit of U.S. Provisional Patent Application No. 60/778,932, filed on Mar. 6, 2006, in the U.S. Patent trademark Office, and of Korean Patent Application No. 10-2006-0049036, filed on May 30, 2006 and Korean Patent Application No. 10-2006-0109523, filed on Nov. 7, 2006. in the Korean Intellectual Property Office, the disclosures of which are incorporated herein in their entirety by reference.

BACKGROUND OF THE INVENTION

1. Field of the Invention

One or more embodiments of the present invention relate to audio coding, and more particularly, to a method, medium, and system generating a 3-dimensional (3D) signal in a decoder by using a surround data stream.

2. Description of the Related Art

FIG. 1 illustrates a conventional apparatus for generating a stereo signal. Here, a quadrature mirror filter (QMF) analysis filterbank 100 receives an input of a downmixed signal and transforms the time domain signal to the QMF domain. The downmixed signal is a signal that previous to encoding included one or more additional signals/channels, but which now represents all of the signals/channels with less signals/channels. An upmixing would be the conversion or expanding the downmixed signals/channels into a multi-channel signal, e.g., similar to its original channel form previous to encoding. Thus, after transforming of the time domain signal to the QMF domain, a surround decoding unit 110 decodes the downmixed signal, to thereby upmix the signal. A QMF synthesis filterbank 120 then inverse transforms the resultant multi-channel signal in the QMF domain to the time domain. A Fourier transform unit 130 further applies a faster Fourier transform (FFT) to this resultant time domain multi-channel signal. A binaural processing unit 140 then downmixes the resultant frequency domain multi-channel signal, transformed to the frequency domain in the Fourier transform unit 130, by applying a head related transfer function (HRTF) to the signal, to generate a corresponding stereo signal with only two channels based on the multi-channel signal. Thereafter, an inverse Fourier transform unit 150 inverse transforms the frequency domain stereo signal to the time domain.

Again, surround decoding unit 110 processes an input signal in the QMF domain, while the HRTF function is generally applied in the frequency domain in the binaural processing unit 140. Since the surround decoding unit 110 and the binaural processing unit 140 operate in different respective domains, the input downmix signal must be transformed to the QMF domain and processed in the surround decoding unit 110, and then, the signal must be inverse transformed to the time domain, and then, again transformed to the frequency domain. Only then, is an HRFT applied to the signal in the binaural processing unit, followed by the inverse transforming of the signal to the time domain. Accordingly, since transform and inverse transform are separately performed with respect to each of the QMF domain and the frequency domain, when decoding is performed in a decoder, the complexity increases. With such complexity, such an arrangement may not be suitable for a mobile environment, for example. In addition to the complexity, sound quality is also degraded in the processes of transforming or inverse transforming a domain representation, such as transforming a QMF domain representation to a time domain representation, transforming a time domain representation to a frequency domain representation, and inverse transforming a frequency domain representation to a time domain representation.

SUMMARY

Accordingly, one or embodiments of the present invention provide a method, medium, and system for applying a head related transfer function (HRTF) within the quadrature mirror filter (QMF) domain, thereby generating a simplified 3-dimensional (3D) signal by using a surround data stream.

Additional aspects and/or advantages of the invention will be set forth in part in the description which follows and, in part, will be apparent from the description, or may be learned by practice of the invention.

According to an aspect of the present invention, an embodiment of the present invention includes a method of generating an upmixed signal from a downmixed signal, including transforming the downmixed signal into a sub-band filter domain, and generating and outputting the upmixed signal from the transformed signal based on spatial information for the downmixed signal and a head related transfer function (HRTF) parameter in the sub-band filter domain.

According to another aspect of the present invention, an embodiment of the present invention includes a method of generating an upmixed signal from a downmixed signal, including transforming the downmixed signal into a sub-band filter domain, generating the upmixed signal from the transformed signal based on spatial information for the downmixed signal and a head related transfer function (HRTF) parameter, inverse transforming the upmixed signal from the sub-band filter domain to a time domain, and outputting the inverse transformed upmixed signal.

According to another aspect of the present invention, an embodiment of the present invention includes a method of generating an upmixed signal from a downmixed signal, including transforming the downmixed signal into a sub-band filter domain, generating a decorrelated signal from the transformed signal by using spatial information, generating the upmixed signal from the transformed signal and the generated decorrelated signal by using the spatial information and an HRTF parameter, inverse transforming the upmixed signal from the sub-band filter domain to a time domain, and outputting the inverse transformed upmixed signal.

According to another aspect of the present invention, an embodiment of the present invention includes a method of generating an upmixed signal from a downmixed signal, including transforming the downmixed signal to a sub-band filter domain, transforming a non-sub-band filter domain HRTF parameter into a sub-band filter domain HRTF parameter, generating the upmixed signal from the transformed signal based on spatial information and the sub-band filter domain HRTF parameter, and outputting the upmixed signal.

According to another aspect of the present invention, an embodiment of the present invention includes a method of generating an upmixed signal from a downmixed signal, including transforming the downmixed signal to a sub-band filter domain, transforming a non-sub-band filter domain HRTF parameter into a sub-band filter domain HRTF parameter, generating a decorrelated signal from the transformed signal by using spatial information, generating the upmixed signal from the transformed signal and the generated decorrelated signal by using the spatial information and the sub-band HRTF parameter, and outputting the upmixed signal.

According to another aspect of the present invention, an embodiment of the present invention includes a least one medium including computer readable code to control at least one processing element to implement at least an embodiment of the present invention.

According to another aspect of the present invention, an embodiment of the present invention includes a system generating an upmixed signal from a downmixed signal, including a domain transform unit to transform the downmixed signal to a sub-band filter domain, and a signal generation unit to generate the upmixed signal from the transformed signal based on spatial information and an HRTF parameter in the sub-band filter domain.

According to another aspect of the present invention, an embodiment of the present invention includes a system generating an upmixed signal from a downmixed signal, including a domain transform unit to transform the downmixed signal to a sub-band filter domain, and a signal generation unit to generate the upmixed signal from the transformed signal based on spatial information and an HRTF parameter, and a domain inverse transform unit to inverse transform the upmixed signal from the sub-band filter domain to a time domain.

According to another aspect of the present invention, an embodiment of the present invention includes a system generating an upmixed signal from a downmixed signal, including a domain transform unit to transform the downmixed signal to a sub-band filter domain, a decorrelator to generate a decorrelated signal from the transformed signal by using spatial information, a signal generation unit to generate the upmixed signal from the transformed signal and the generated decorrelated signal by using the spatial information and an HRTF parameter, and a domain inverse transform unit to inverse transform the upmixed signal from the sub-band filter domain to a time domain.

According to another aspect of the present invention, an embodiment of the present invention includes a system generating an upmixed signal from a downmixed signal, including a domain transform unit to transform the downmixed signal to a sub-band filter domain, an HRTF parameter transform unit to transform a non-sub-band filter domain HRTF parameter into a sub-band filter domain HRTF parameter, and a signal generation unit to generate the upmixed signal from the transformed signal based on spatial information and the sub-band filter domain HRTF parameter.

According to another aspect of the present invention, an embodiment of the present invention includes a system generating an upmixed signal from a downmixed signal, including a domain transform unit to transform the downmixed signal to a sub-band filter domain, an HRTF parameter transform unit to transform a non-sub-band filter domain HRTF parameter into a sub-band filter domain HRTF parameter, a decorrelator to generate a decorrelated signal from the transformed signal by using spatial information, and a signal generation unit to generate the upmixed signal from the transformed signal and the generated decorrelated signal by using the spatial information and the sub-band filter domain HRTF parameter.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF EMBODIMENTS

Figure 1:
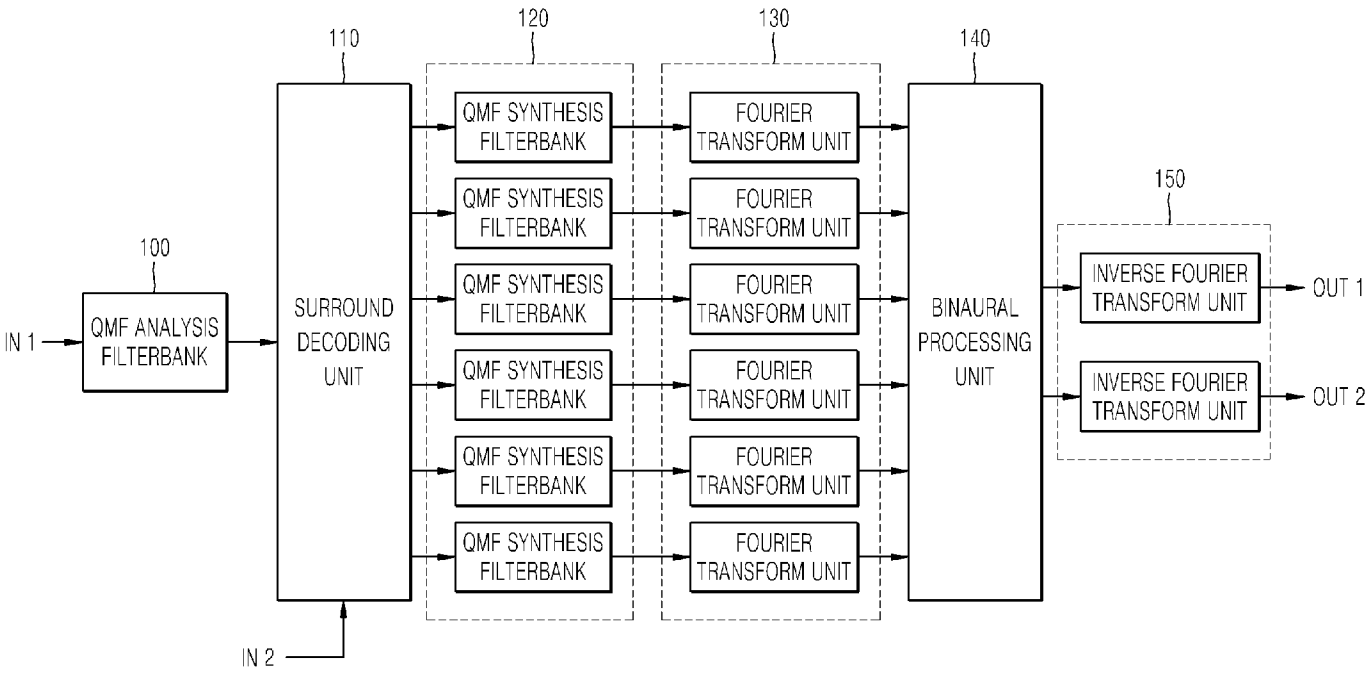
FIG. 1 (PRIOR ART)
FIG. 1 illustrates a conventional apparatus for generating a stereo signal.

Reference will now be made in detail to embodiments of the present invention, examples of which are illustrated in the accompanying drawings, wherein like reference numerals refer to the like elements throughout. Embodiments are described below to explain the present invention by referring to the figures.

Figure 2:
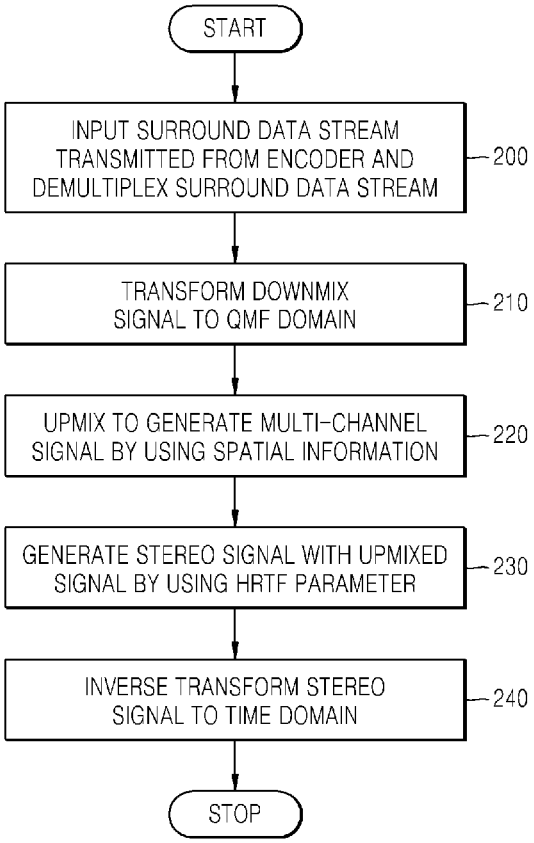
FIG. 2 illustrates a method of generating a stereo signal, according to an embodiment of the present invention.

FIG. 2 illustrates a method of generating a stereo signal, according to an embodiment of the present invention.

A surround data stream including a downmix signal and spatial parameters (spatial cues) may be received and demultiplexed, in operation 200. Here, as noted above, the downmix signal can be a mono or stereo signal that was previously compressed/downmixed from a mulit-channel signal.

The demultiplexed downmix signal may then be transformed from the time domain to the quadrature mirror filter (QMF) domain, in operation 210.

The QMF domain downmix signal may then be decoded, thereby upmixing the QMF domain signal to a multi-channel signal by using the provided spatial information, in operation 220. For example, in the case of a pre-encoded 5.1 multi-channel signal, the corresponding downmixed signal can be upmixed to back into the corresponding decoded 5.1 multi-channel signal of 6 channels, including a front left (FL) channel, a front right (FR) channel, a back left (BL) channel, a back right (BR) channel, a center (C) channel, and a low frequency enhancement (LFE) channel, in operation 220.

Thereafter, the upmixed multi-channel signal may be used to generate a 3-dimnesional (3D) stereo signal, in operation 230, by using a head related transfer function (HRTF) that has been transformed for application in the QMF domain. At this time the transformed QMF domain HRTF may also be preset for use with the upmixed multi-channel signal. Thus, here, in operation 230, rather than using an HRTF parameter that is generally expressed in the time domain, an HRTF parameter that has been transformed for application in the QMF domain is used. Here, the time-domain HRTF parameter/transfer function can be transformed into the QMF domain by transforming the time response of an HRTF to the QMF domain, and, for example, by calculating an impulse response in each sub-band. Such a transforming of the time-domain HRTF parameter may be also referred to as an HRTF parameterizing in the QMF domain, or as filter morphing of the time-domain HRTF filters, for example. Similarly, the QMF domain can be considered as falling within a class of sub-band filters, since sub bands are being filtered. Thus, such application of the HRTF parameter in the QMF domain permits for selective upmixing, with such HRTF filtering, of different levels of QMF domain sub-band filtering, e.g., one, some, or all sub-bands depending on the available of processing/battery power, for example. In some embodiments, in order to reduce complexity, the LFE channel may not be used in operation 230. Regardless, such a 3D stereo signal corresponding to the QMF domain can be generated using the below equation 1, for example.

$$\begin{pmatrix} \text{x_left}[sb][timeslot] \\ \text{x_right}[sb][timeslot] \end{pmatrix} = \begin{pmatrix} a11 & a12 & a13 & a14 & a15 & a16 \\ a21 & a22 & a23 & a24 & a25 & a26 \end{pmatrix} \cdot \begin{pmatrix} \text{x_FL}[sb][timeslot] \otimes HRTF1[sb][timeslot] \\ \text{x_FR}[sb][timeslot] \otimes HRTF2[sb][timeslot] \\ \text{x_BL}[sb][timeslot] \otimes HRTF3[sb][timeslot] \\ \text{x_BR}[sb][timeslot] \otimes HRTF4[sb][timeslot] \\ \text{x_C}[sb][timeslot] \otimes HRTF5[sb][timeslot] \\ \text{x_LFE}[sb][timeslot] \otimes HRTF6[sb][timeslot] \end{pmatrix} \quad \text{Equation 1}$$

Here, x_left[sb][timeslot] is the L channel signal expressed in the QMF domain, x_right[sb][timeslot] is the R channel signal expressed in the QMF domain, a11, a12, a13, a14, a15, a16, a21, a22, a23, a24, a25, and a26 may be constants, x_FL[sb][timeslot] is the FL channel signal expressed in the QMF domain, x_FR[sb][timeslot] is the FR channel signal expressed in the QMF domain, x_BL[sb][timeslot] is the BL channel signal expressed in the QMF domain, x_C[sb][timeslot] is the C channel signal expressed in the QMF domain, x_LFE[sb][timeslot] is the LFE channel signal expressed in the QMF domain, HRTF1[sb][timeslot] is the HRTF parameter with respect to the FL channel expressed in the QMF domain, HRTF2[sb][timeslot] is the HRTF parameter with respect to the FR channel expressed in the QMF domain, HRTF3[sb][timeslot] is the HRTF parameter with respect to the BL channel expressed in the QMF domain, HRTF4[sb][timeslot] is the HRTF parameter with respect to the BR channel expressed in the QMF domain, HRTF5[sb][timeslot] is the HRTF parameter with respect to the C channel expressed in the QMF domain, and HRTF6[sb][timeslot] is the HRTF parameter with respect to the LFE channel expressed in the QMF domain, In operation 230, although an embodiment where a HRTF parameter that has been transformed for application in the QMF domain has been used, in other embodiments, a separate operation for transforming a time domain, for example, HRTF parameter to the QMF domain may also be performed.

Further to operation 230, the generated 3D stereo signal can be inverse transformed from the QMF domain to the time domain, in operation 240.

Here, by transforming the downmix signal by using a QMF analysis filterbank in operation 210, and by inverse transforming the stereo signal generated in operation 230 by using a QMF synthesis filterbank in operation 240, this QMF domain method embodiment may equally be available as operating in a hybrid sub-band domain or other sub-band filtering domains known in the art, according to an embodiment of the present invention.

Figure 3:
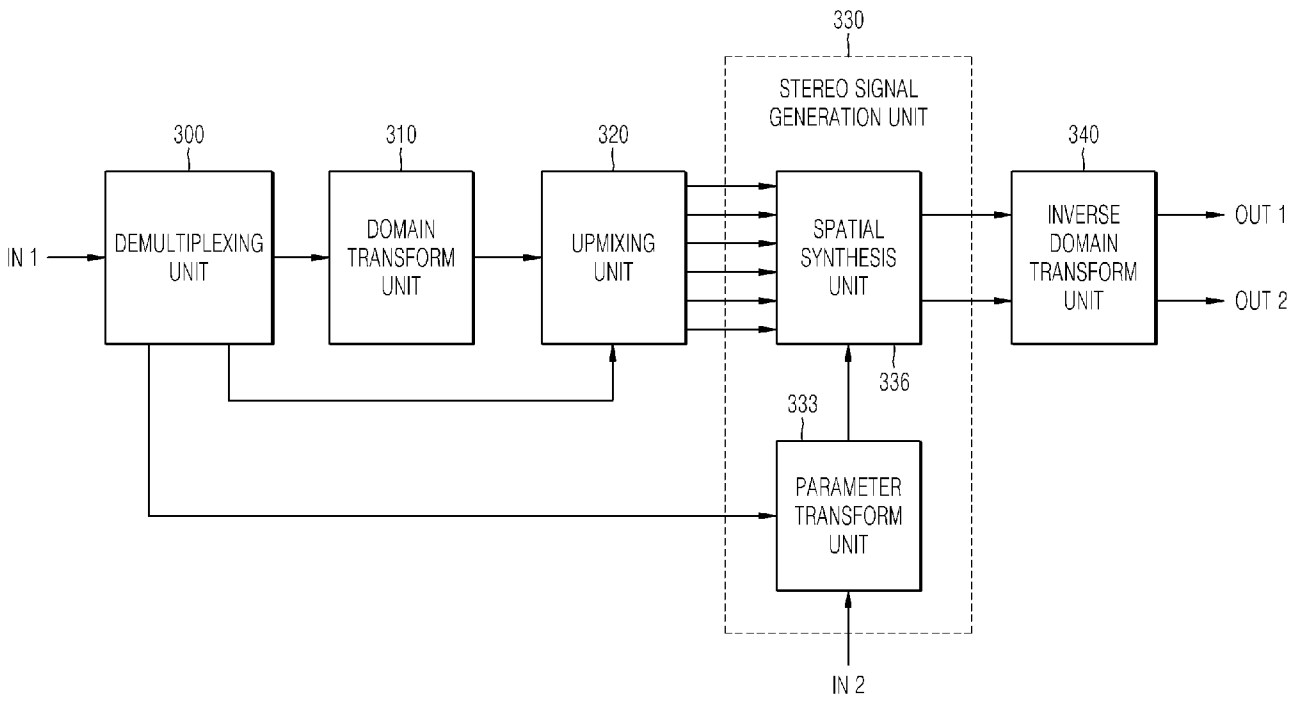
FIG. 3 illustrates a system for generating a stereo signal, according to an embodiment of the present invention.

FIG. 3 illustrates a system for generating a stereo signal, according to an embodiment of the present invention. The system may include a demultiplexing unit 300, a domain transform unit 310, an upmixing unit 320, a stereo signal generation unit 330, and a domain inverse transform unit 340, for example.

The demultiplexing unit 300 may receive, e.g., through an input terminal IN 1, a surround data stream including a downmix signal and a spatial parameter, e.g., as transmitted by an encoder, and demultiplex and output the surround data stream.

The domain transform unit 310 may then transform the demultiplexed downmix signal from the time domain to the QMF domain.

The upmixing unit 320 may, thus, receive a QMF domain downmix signal, decode the signal, and upmix the signal into a multi-channel signal. For example, in the case of a 5.1-channel signal, the upmixing unit upmixes the QMF domain downmix signal to a multi-channel signal of 6 channels, including FL, FR, BL, BR, C, and LFE channels.

The stereo signal generation unit 330 may thereafter generate a 3D stereo signal, in the QMF domain, with the upmixed multi-channel signal. In the generation of the stereo signal, the stereo signal generation unit 330 may thus use a QMF applied HRTF parameter, e.g., received through an input terminal IN 2. Here, the stereo generation unit 330 may further include a parameter transform unit 333 and a calculation unit 336, for example.

In one embodiment, the parameter transform unit 333 may receive a time-domain HRTF parameter, e.g., through the input terminal IN 2, and transform the time-domain HRTF parameter for application in the QMF domain. In one embodiment, for example, the parameter transform unit 333 may transform the time response of the HRTF to the QMF domain and, for example, calculate an impulse response with respect to each sub-band, thereby transforming the time-domain HRTF parameter to the QMF domain.

In another embodiment, a preset QMF domain HRTF parameter may be previously stored and read out when needed. Here it is noted that alternative embodiments for providing a QMF domain HRTF parameter may equally be implemented Referring to FIG. 3, the spatial synthesis unit 336 may generate a 3D stereo signal with the upmixed multi-channel signal, by applying the QMF domain HRTF parameter or by applying the above mentioned preset stored QMF domain HRTF parameter, for example. As noted above, in one embodiment, the spatial synthesis unit 336 may not use the LFE channel in order to reduce complexity. Regardless, the spatial synthesis unit 336 may generate a 3D stereo signal corresponding in the QMF domain by using the below Equation 2, for example.

$$\begin{pmatrix} \text{x_left}[sb][timeslot] \\ \text{x_right}[sb][timeslot] \end{pmatrix} = \begin{pmatrix} a11 & a12 & a13 & a14 & a15 & a16 \\ a21 & a22 & a23 & a24 & a25 & a26 \end{pmatrix} \cdot \begin{pmatrix} \text{x_FL}[sb][timeslot] \otimes HRTF1[sb][timeslot] \\ \text{x_FR}[sb][timeslot] \otimes HRTF2[sb][timeslot] \\ \text{x_BL}[sb][timeslot] \otimes HRTF3[sb][timeslot] \\ \text{x_BR}[sb][timeslot] \otimes HRTF4[sb][timeslot] \\ \text{x_C}[sb][timeslot] \otimes HRTF5[sb][timeslot] \\ \text{x_LFE}[sb][timeslot] \otimes HRTF6[sb][timeslot] \end{pmatrix} \quad \text{Equation 2}$$

Here, x_left[sb][timeslot] is the L channel signal expressed in the QMF domain, x_right[sb][timeslot] is the R channel signal expressed in the QMF domain, a11, a12, a13, a14, a15, a16, a21, a22, a23, a24, a25, and a26 may be constants, x_FL[sb][timeslot] is the FL channel signal expressed in the QMF domain, x_FR[sb][timeslot] is the FR channel signal expressed in the QMF domain, x_BL[sb][timeslot] is the BL channel signal expressed in the QMF domain, x_C[sb][timeslot] is the C channel signal expressed in the QMF domain, x_LFE[sb][timeslot] is the LFE channel signal expressed in the QMF domain, HRTF1[sb][timeslot] is the HRTF parameter with respect to the FL channel expressed in the QMF domain, HRTF2[sb][timeslot] is the HRTF parameter with respect to the FR channel expressed in the QMF domain, HRTF3[sb][timeslot] is the HRTF parameter with respect to the BL channel expressed in the QMF domain, HRTF4[sb][timeslot] is the HRTF parameter with respect to the BR channel expressed in the QMF domain, HRTF5[sb][timeslot] is the HRTF parameter with respect to the C channel expressed in the QMF domain, and HRTF6[sb][timeslot] is the HRTF parameter with respect to the LFE channel expressed in the QMF domain.

The domain inverse transform unit 340 may thereafter inverse transforms the QMF domain 3D stereo signal into the time domain, and may, for example, output the L and R channel signals through output terminals OUT 1 and OUT 2, respectively.

Here, by transforming a demultiplexed downmix signal by the domain transform unit 310 by using a QMF analysis filterbank, and by inverse transforming the QMF domain 3D stereo signal generated in the spatial synthesis unit 336 by using a QMF synthesis filterbank, the domain transform unit 310 may equally be available to operate in a hybrid sub-band domain as know in the art, according to an embodiment of the present invention.

Figure 4:
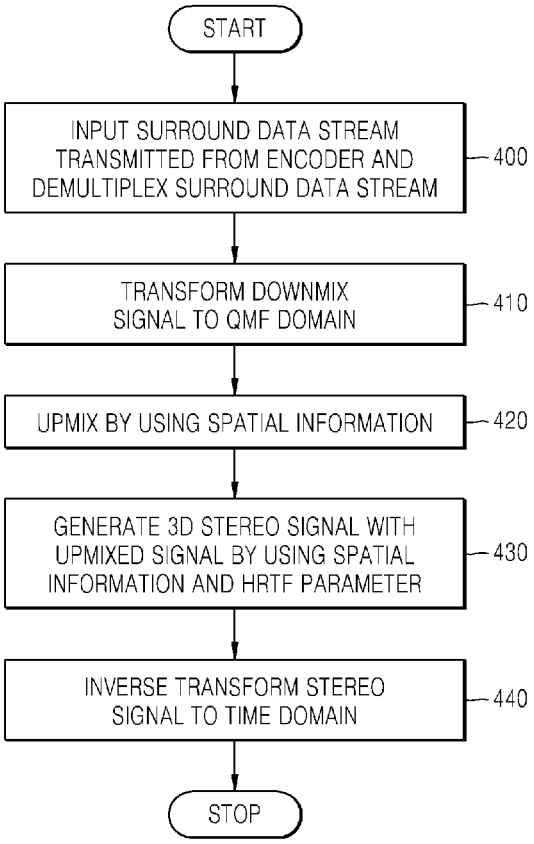
FIG. 4 illustrates a method of generating a stereo signal, according to another embodiment of the present invention.

FIG. 4 illustrates a method of generating a stereo signal, according to another embodiment of the present invention.

A surround data stream, including a downmix signal and spatial parameters (spatial cues), may be received and demultiplexed, in operation 400. Here, as noted above, the downmix signal can be a mono or stereo signal that was previously compressed/downmixed from a multi-channel signal.

The demultiplexed downmix signal output may then be transformed from the time domain to the QMF domain, in operation 410.

The QMF domain downmix signal may then be decoded, thereby upmixing the QMF domain signal to a number of channel signals by using the provided spatial information, in operation 420. Unlike the above embodiment where all available channels of the multi-channel signal may be upmixed, in operation 420, all available channels may not be upmixed. For example, in the case of 5.1 channels, only 2 channels among the 6 available multi-channels may be output, and as another example, in the case of 7.1 channels, only 2 channels among the available 8 multi-channels may be output, noting that embodiments of the present invention are not limited to the selection of only 2 channels or the selection of any two particular channels. More particularly, in this 5.1 channels signal example, only FL and FR channel signals may be output among the available 6 multi-channel signals of FL, RF, BL, BR, C, and LFE channel signals.

By using the spatial information and the QMF domain HRTF, a 3D stereo signal may be generated from the selected 2 channel signals, in operation 430. In operation 430, the QMF domain HRTF parameter may be preset and applied to the select channel signals. As noted above, the QMF domain HRTF parameter may be obtained by transforming the time response of the HRTF to the QMF domain, and calculating an impulse response in each sub-band. In one embodiment, in operation 430, in order to reduce complexity, the LFE channel may not be used. Regardless, in an embodiment in which the FR and FR channel signals are the select two channels signals, by using the spatial information and the QMF domain HRTF parameter, a 3D stereo signal may be generated using the below equation 3, for example.

$$\begin{pmatrix} \text{x_left}[sb][timeslot] \\ \text{x_right}[sb][timeslot] \end{pmatrix} = \begin{pmatrix} a11 & a12 & a13 & a14 & a15 & a16 \\ a21 & a22 & a23 & a24 & a25 & a26 \end{pmatrix} \cdot \begin{pmatrix} \text{x_FL}[sb][timeslot] \otimes HRTF1[sb][timeslot] \\ \text{x_FR}[sb][timeslot] \otimes HRTF2[sb][timeslot] \\ \text{x_FL}[sb][timeslot]CLD3[sb][timeslot] \otimes \\ HRTF3[sb][timeslot] \\ \text{x_FR}[sb][timeslot]CLD4[sb][timeslot] \otimes \\ HRTF4[sb][timeslot] \\ CLD3[sb][timeslot](\text{x_FL}[sb][timeslot]CLD3 \\ [sb][timeslot] \otimes HRTF5[sb][timeslot] + \\ \text{x_FR}[sb][timeslot] \otimes HRTF6[sb][timeslot]) \\ \text{x_LFE}[sb][timeslot]CLD5[sb][timeslot] \otimes \\ HRTF7[sb][timeslot] \end{pmatrix} \quad \text{Equation 3}$$

Here, x_left[sb][timeslot] is the L channel signal expressed in the QMF domain, x_right[sb][timeslot] is the R channel signal expressed in the QMF domain, a11, a12, a13, a14, a15, a16, a21, a22, a23, a24, a25, and a26 may be constants, x_FL[sb][timeslot] is the FL channel signal expressed in the QMF domain, In addition, the described CLD 3, CLD 4 and CLD 5 are channel level differences specified in an MPEG surround specification, HRTF1[sb][timeslot] is the HRTF parameter with respect to the FL channel expressed in the QMF domain, HRTF2[sb][timeslot] is the HRTF parameter with respect to the FR channel expressed in the QMF domain, HRTF3[sb][timeslot] is the HRTF parameter with respect to the BL channel expressed in the QMF domain, HRTF4[sb][timeslot] is the HRTF parameter with respect to the BR channel expressed in the QMF domain, HRTF5[sb][timeslot] is the HRTF parameter with respect to the C channel expressed in the QMF domain, and HRTF6[sb][timeslot] is the HRTF parameter with respect to the LFE channel expressed in the QMF domain.

Thereafter, the generated 3D stereo signal generated may be inverse transformed from the QMF domain to the time domain, in operation 440.

Here, by transforming the downmix signal by using a QMF analysis filterbank in operation 410, and by inverse transforming the stereo signal generated in operation 430 by using a QMF synthesis filterbank in operation 440, this QMF domain method embodiment may equally be available as operating in a hybrid sub-band domain as known in the art, for example, according to an embodiment of the present invention.

Figure 5:
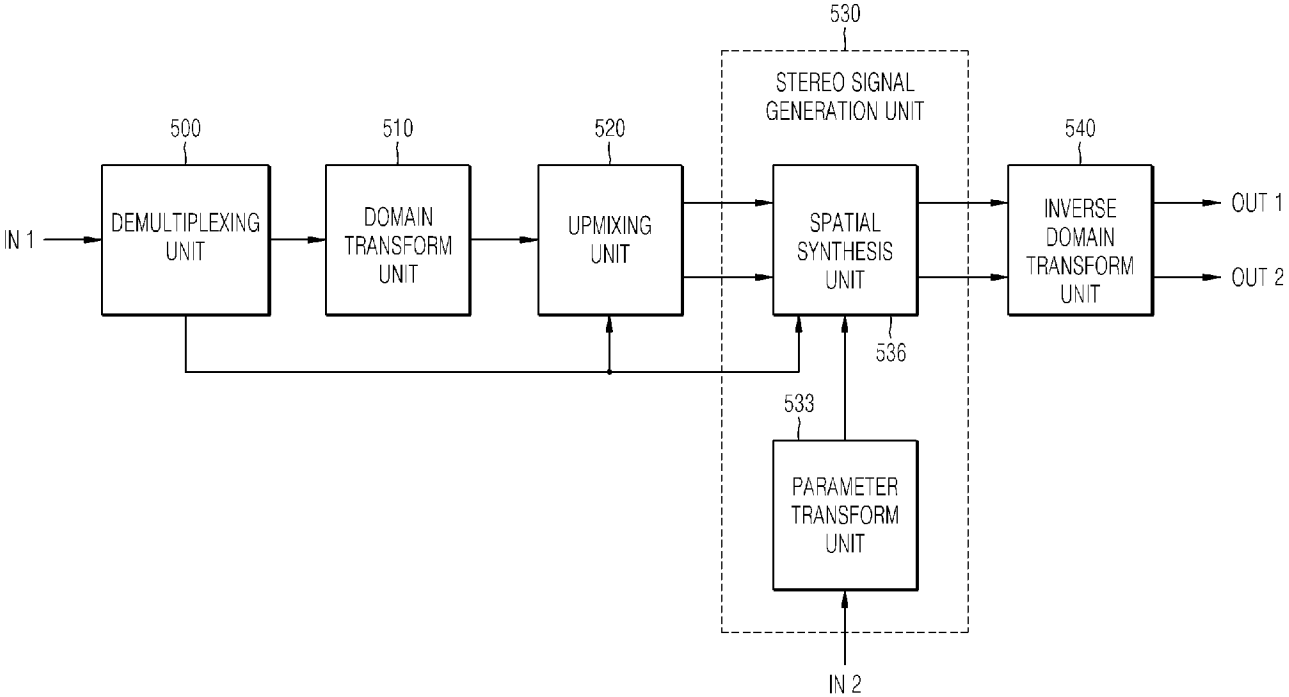
FIG. 5 illustrates a system for generating a stereo signal, according to another embodiment of the present invention.

FIG. 5 illustrates a system for generating a stereo signal, according to another embodiment of the present invention. The system may include a demultiplexing unit 500, a domain transform unit 510, an upmixing unit 520, a stereo signal generation unit 530, and a domain inverse transform unit 540, for example.

The demultiplexing unit 500 may receive, e.g., through an input terminal IN 1, a surround data stream including a downmix signal and spatial parameters, e.g., as transmitted by an encoder, and demultiplex and output the surround data stream.

The domain transform unit 510 may then transform the demultiplexed downmix signal from the time domain to the QMF domain.

The upmixing unit 520 may receive a QMF domain downmix signal, decode the signal, and by using spatial information, upmix the signal to select channels, which does not have to include all available channels that could have been upmixed into a multi-channels signal. Thus, here, unlike the aforementioned embodiment, the upmixing unit 520 may output only 2 select channels among the 6 available channels in the case of 5.1 channels, and may output only 2 select channels among 8 available channels in the case of 7.1 channels. in one example, in the case of 5.1 multi-channel signals, the upmixing unit 520 may output only select FL and FR channel signals among the 6 available multi-channel signals, including FL, RF, BL, BR, C, and LFE channel signals, again noting that embodiments of the present invention are not limited to these particular example select channels or only two select channels.

Thereafter, stereo signal generation unit 530 may generate a QMF 3D stereo signal with the 2 select channel signals, e.g., output from the upmixing unit 520. In the generation of the QMF 3D stereo signal, the stereo signal generation unit 530 may use the spatial information output, e.g., from the demultiplexing unit 500, and a time-domain HRTF parameter, e.g., received through an input terminal IN 2. Here, the stereo generation unit 530 may include a parameter transform unit 533 and a calculation unit 536, for example.

The parameter transform unit 533 may receive the time-domain HRTF parameter, and transform the time-domain HRTF parameter for application in the QMF domain. Thus, the parameter transform unit 533 may transform the time-domain HRTF parameter by transforming the time response of the HRTF into a hybrid sub-band domain, for example, and then calculate an impulse response in each sub-band.

However, similar the above, a preset QMF domain HRTF parameter may be previously stored and read out when needed. Here, it is again noted that alternative embodiments for providing a QMF domain HRTF parameter may equally be implemented.

Referring to FIG. 5, the spatial synthesis unit 536 may generate a 3D stereo signal with the 2 select channel signals output from the upmixing unit 520, by using the spatial information and the QMF domain HRTF parameter.

In one embodiment in which a FL channel signal and a FR channel signal from the upmixing unit 520 may be received by the spatial synthesis unit 536, for example, and a QMF 3D stereo signal may be generated by using the spatial information and the QMF domain HRTF parameter using the below Equation 4, for example.

$$\begin{pmatrix} \text{x_left}[sb][timeslot] \\ \text{x_right}[sb][timeslot] \end{pmatrix} = \begin{pmatrix} a11 & a12 & a13 & a14 & a15 & a16 \\ a21 & a22 & a23 & a24 & a25 & a26 \end{pmatrix}.$$

-continued $$\begin{pmatrix} \text{x_FL}[sb][timeslot] \otimes HRTF1[sb][timeslot] \\ \text{x_FR}[sb][timeslot] \otimes HRTF2[sb][timeslot] \\ \text{x_FL}[sb][timeslot]CLD3[sb][timeslot] \otimes \\ HRTF3[sb][timeslot] \\ \text{x_FR}[sb][timeslot]CLD4[sb][timeslot] \otimes \\ HRTF4[sb][timeslot] \\ CLD3[sb][timeslot](\text{x_FL}[sb][timeslot] \\ CLD3[sb][timeslot] \otimes HRTF5[sb][timeslot] + \\ \text{x_FR}[sb][timeslot] \otimes HRTF6[sb][timeslot]) \\ \text{x_LFE}[sb][timeslot]CLD5[sb][timeslot] \otimes HRTF7[sb][timeslot] \end{pmatrix}$$

Here, x_left[sb][timeslot] is the L channel signal expressed in the QMF domain, x_right[sb][timeslot] is the R channel signal expressed in the QMF domain, a11, a12, a13, a14, a15, a16, a21, a22, a23, a24, a25, and a26 may be constants, x_FL[sb][timeslot] is the FL channel signal expressed in the QMF domain, In addition, the described CLD 3, CLD 4 and CLD 5 are channel level differences specified in an MPEG surround specification, HRTF1[sb][timeslot] is the HRTF parameter with respect to the FL channel expressed in the QMF domain, HRTF2[sb][timeslot] is the HRTF parameter with respect to the FR channel expressed in the QMF domain, HRTF3[sb][timeslot] is the HRTF parameter with respect to the BL channel expressed in the QMF domain, HRTF4[sb][timeslot] is the HRTF parameter with respect to the BR channel expressed in the QMF domain, HRTF5[sb][timeslot] is the HRTF parameter with respect to the C channel expressed in the QMF domain, and HRTF6[sb][timeslot] is the HRTF parameter with respect to the LFE channel expressed in the QMF domain, The domain inverse transform unit 540 may further inverse transform the QMF domain 3D stereo signal to the time domain, and, in one embodiment, output the L channel signal and the R channel signal through output terminals OUT 1 and OUT 2, respectively, for example.

Here, by disposing a QMF analysis filterbank as the domain transform unit 510 and a QMF synthesis filterbank as the domain inverse transform unit 540, the current embodiment may equally be available to operate in a hybrid sub-band domain as known in the art, for example, according to an embodiment of the present invention.

Figure 6:
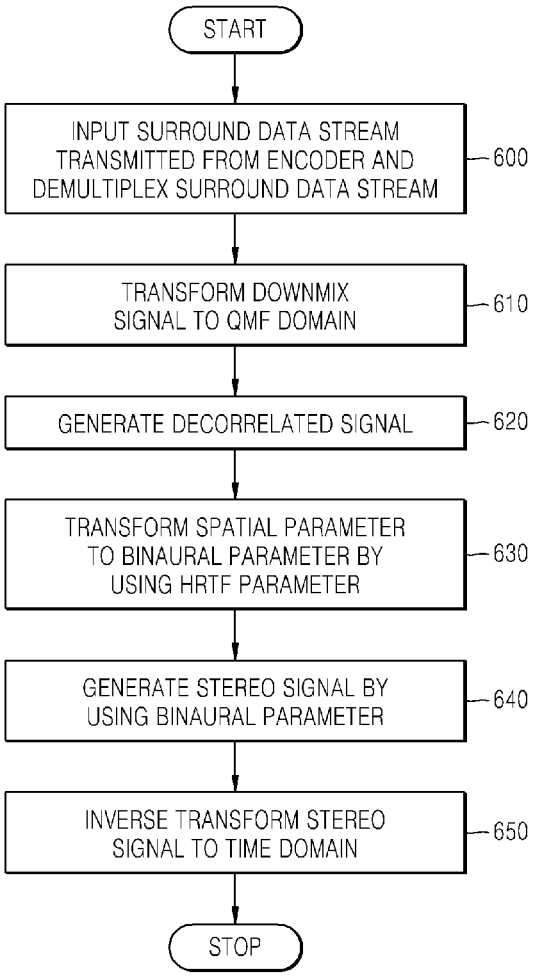
FIG. 6 illustrates a method of generating a stereo signal, according to another embodiment of the present invention.

FIG. 6 illustrates a method of generating a stereo signal, according to another embodiment of the present invention.

A surround data stream, including a downmix signal and spatial parameters (spatial cues), may be received and demultiplexed, in operation 600. Here, as noted above, the downmix signal can be a mono signal, for example, that was previously compressed/downmixed from a multi-channel signal.

The demultiplexed mono downmix signal may be transformed from the time domain to the QMF domain, in operation 610.

Thereafter, a decorrelated signal may be generated by applying the spatial information to the QMF domain mono downmix signal, and in operation 620.

By using an HRTF parameter, the spatial information may be transformed to a binaural 3D parameter, in operation 630. Here, the binaural 3D parameter is expressed in QMF domain, and is used in a process in which the mono downmix signal and the decorrelated signal are input and calculation is performed in order to generate a 3D stereo signal.

Then, a 3D stereo signal may be generated by applying the binaural 3D parameter to the mono downmix signal and the decorrelated signal, in operation 640.

The generated 3D stereo signal may then be inverse transformed from the QMF domain to the time domain, in operation 650.

Here, by transforming the downmix signal by using a QMF analysis filterbank in operation 610, and by inverse transforming the 3D stereo signal generated in operation 640 by using a QMF synthesis filterbank in operation 650, this QMF domain method embodiment may equally be available as operating in a hybrid sub-band domain as known in the art, for example, according to an embodiment of the present invention.

Figure 7:
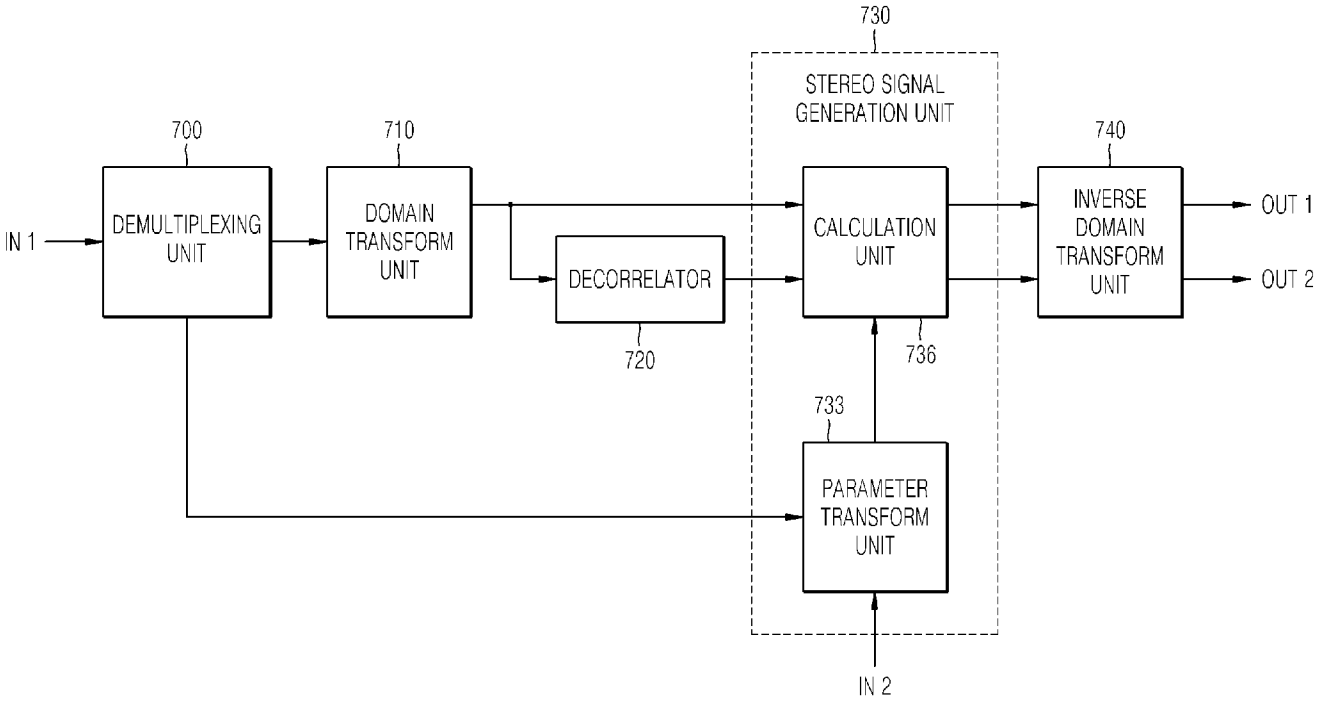
FIG. 7 illustrates a system for generating a stereo signal, according to another embodiment of the present invention.

FIG. 7 illustrates a system for generating a stereo signal, according to another embodiment of the present invention. The system may include a demultiplexing unit 700, a domain transform unit 710, a decorrelator 720, a stereo signal generation unit 730, and a domain inverse transform unit 740, for example.

The demultiplexing unit 700 may receive, e.g., through an input terminal IN 1, a surround data stream including a downmix signal and spatial parameters, e.g., as transmitted by an encoder, and demultiplex the surround data stream. As noted above, the downmix signal may be a mono signal, for example.

The domain transform unit 710 may then transform the mono downmix signal from the time domain to the QMF domain.

The decorrelator 720 may then generate a decorrelated signal by applying the spatial information and the QMF domain mono downmix signal.

The stereo signal generation unit 730 may further generate a QMF domain 3D stereo signal from the QMF domain mono downmix signal decorrelated signal. In the generation of the 3D stereo signal, the stereo signal generation unit 730 may use the spatial information and an HRTF parameter, e.g., as received through an input terminal IN 2. Here, the stereo generation unit 730 may include a parameter transform unit 733 and a calculation unit 736.

The parameter transform unit 733 transforms the spatial information to a binaural 3D parameter by using the HRTF parameter. Here, the binaural 3D parameter is expressed in QMF domain, and is used in a process in which the mono downmix signal and the decorrelated signal are input and calculation is performed in order to generate a 3D stereo signal.

Thus, the calculation unit 736 receives the QMF domain mono downmix signal and the decorrelated signal, and through calculation by applying the QMF domain binaural 3D parameter, generates a 3D stereo signal.

Thereafter, the domain inverse transform unit 740 may inverse transform the QMF domain 3D stereo signal to the time domain, and output the L channel signal and the R channel signal through output terminals OUT 1 and OUT 2, respectively, for example.

Here, by disposing a QMF analysis filterbank as the domain transform unit 710 and a QMF synthesis filterbank as the domain inverse transform unit 740, the current embodiment may equally be available to operate in a hybrid sub-band domain as known in the art, for example, according to an embodiment of the present invention.

Accordingly, one or more embodiments of the present invention include a method, medium, and system generating a stereo signal by applying a QMF domain HRTF to generate a 3D stereo signal.

In this way, a compressed/downmixed multi-channel signal can be upmixed through application of an HRTF without requiring repetitive transforming or inverse transforming for application of the HRTF, thereby reducing the complexity and increasing and the quality of the implemented system.

In addition to the above described embodiments, embodiments of the present invention can also be implemented through computer readable code/instructions in/on a medium, e.g., a computer readable medium, to control at least one processing element to implement any above described embodiment. The medium can correspond to any medium/media permitting the storing and/or transmission of the computer readable code.

The computer readable code can be recorded/transferred on a medium in a variety of ways, with examples of the medium including magnetic storage media (e.g., ROM, floppy disks, hard disks, etc.), optical recording media (e.g., CD-ROMs, or DVDs), and storage/transmission media such as carrier waves, as well as through the Internet, for example. Here, the medium may further be a signal, such as a resultant signal or bitstream, according to embodiments of the present invention. The media may also be a distributed network, so that the computer readable code is stored/transferred and executed in a distributed fashion. Still further, as only an example, the processing element could include a processor or a computer processor, and processing elements may be distributed and/or included in a single device.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An apparatus for generating a stereo signal, comprising:

a transform unit to transform a mono downmixed signal to a quadrature mirror filter (QMF) domain signal;

a decorrelator to generate a decorrelated signal from the QMF domain signal;

a signal generating unit to convert spatial information to a binaural 3D parameter in the QMF domain by using a head related transfer function (HRTF) parameter, and to generate a binaural output signal from the QMF domain signal and the generated decorrelated signal by using the converted binaural 3D parameter in the QMF domain; and an inverse transform unit to inverse transform the generated binaural output signal from the QMF domain to a time domain to generate the stereo signal.

2. The apparatus of claim 1, wherein the QMF domain is a hybrid sub-band domain.

3. The apparatus of claim 1 further comprising a domain transform unit to transform a corresponding HRTF parameter into the QMF domain.

4. The apparatus of claim 1, wherein the HRTF parameter is transformed into the QMF domain by transforming a time response of a corresponding HRTF into the QMF domain and calculating an impulse response with respect to each sub-band.

* * * * *